United States Patent [19]

Kitsnik

[11] Patent Number: 4,519,753

[45] Date of Patent: May 28, 1985

[54] DISPLACEMENT PUMP SUITABLE FOR PUMPING SUSPENSIONS

[75] Inventor: Henrik M. Kitsnik, Segmon, Sweden

[73] Assignee: HK-Engineering Aktiebolag, Segmon, Sweden

[21] Appl. No.: 418,185

[22] Filed: Sep. 14, 1982

[30] Foreign Application Priority Data

Oct. 9, 1981 [SE] Sweden ..... 8105988

[51] Int. Cl.[3] ..... F04B 15/02

[52] U.S. Cl. ..... 417/403; 417/555 R; 92/86.5

[58] Field of Search ..... 417/401, 403, 555; 92/86.5

[56] References Cited

U.S. PATENT DOCUMENTS

| | | | |
|---|---|---|---|
| 2,330,781 | 9/1943 | Langmyhr et al. | 92/86.5 X |
| 2,576,687 | 11/1951 | Krehbiel | 417/555 X |
| 3,587,236 | 6/1971 | Bennett | 60/52 |
| 3,621,865 | 11/1971 | Baggaley | 417/401 X |
| 3,667,869 | 6/1972 | Schlecht | 417/346 |
| 4,205,946 | 6/1980 | Huso | 92/86.5 X |

FOREIGN PATENT DOCUMENTS

| | | | |
|---|---|---|---|
| 1823 | 9/1980 | Int'l Pat. Institute | 417/401 |
| 641153 | 1/1979 | U.S.S.R. | 92/86.5 |

*Primary Examiner*—Leonard E. Smith
*Attorney, Agent, or Firm*—Murray, Whisenhunt and Ferguson

[57] ABSTRACT

A hydraulically-driven pump of the displacement type intended particularly for pumping various suspensions of liquids and solid particles (slurry) and/or for high pumping pressures comprises a pump housing with a pump chamber (4) with an inlet pipe and an outlet pipe, and associated inlet, and outlet valve, respectively, and a pump piston, disc (16) or corresponding provided in the pump chamber. The pump housing, which is vertically arranged, also comprises an oil section (6) arranged above the pump chamber and having connection (7) to a high pressure hydraulic unit for producing a working pressure on a working piston or piston disc (17) connected with the pump piston through at least one mechanical connecting member (23), and a clean water section (5) arranged between the oil section (6) and the pump chamber (4), said clean water section extending between the working piston and pump piston so that the same water pressure (Pv), which is of approximately the same magnitude as the pressures in the oil section and in the pump chamber, is exerted on the front side of the working piston as on the rear side of the pump piston.

9 Claims, 10 Drawing Figures

Fig. 3.
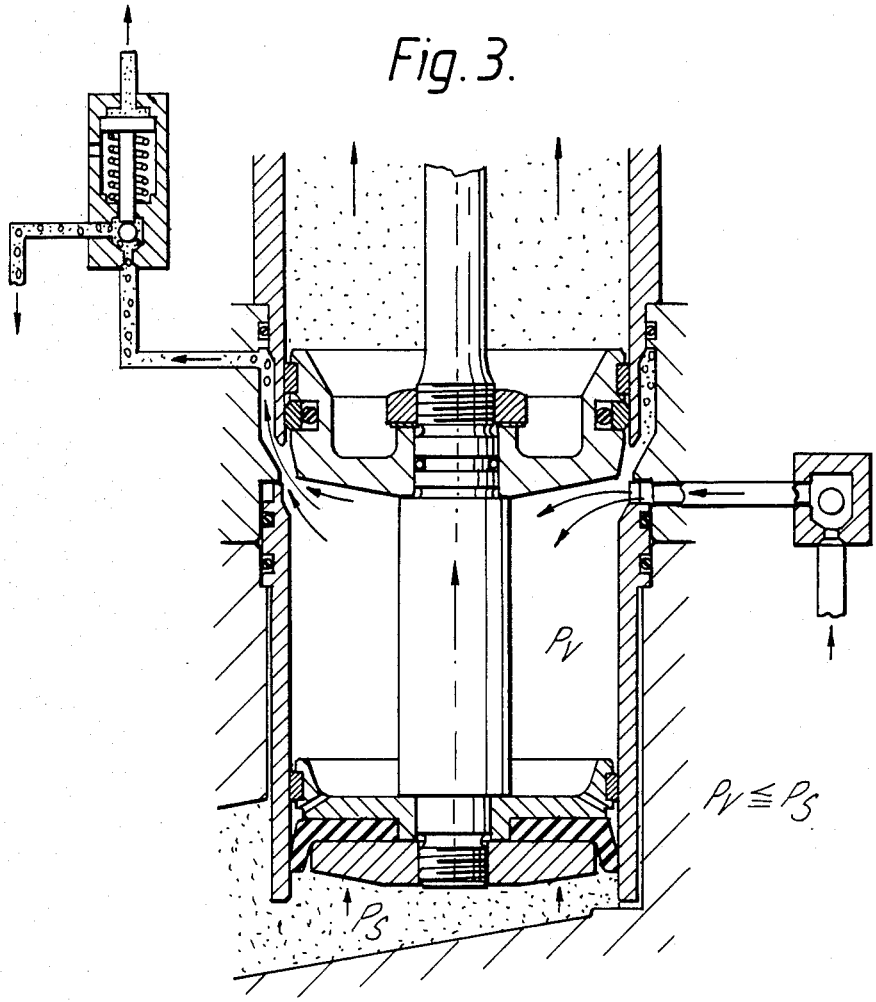
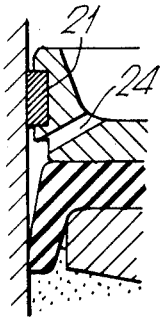
Fig. 3A.

DISPLACEMENT PUMP SUITABLE FOR PUMPING SUSPENSIONS

TECHNICAL FIELD

The present invention relates to a pump of displacement type designed particularly for pumping various suspensions between liquids and solid particles (slurry) and/or for high pumping pressure, comprising a pump housing with a pump chamber having an inlet pipe and an outlet pipe together with the associated inlet and outlet valve respectively, also a pump piston, disc or the like arranged in the pump chamber. The pump in accordance with the invention is specially envisaged for the transport of abrasive substance in the form of slurry in pipelines, e.g. ore concentrates, pulverised coal, colour pigments and the like, also naturally for the pumping of less abrasive products such as slurried peat. The pump has certain advantages also for pumping thick media with or without abrasive properties, likewise at high pumping pressure regardless of the pumping medium. For example in the oil exploration industry, both offshore and land-based, the pump can be employed for pumping drilling mud.

BACKGROUND

Displacement pumps which are designed for slurry pumping are encountered in mainly two designs, either as piston pumps preferably double-piston pumps, or as plunger pumps. Piston pumps are considered to be most suitable for the pressure range up to 200 bar and for less abrasive media, whilst the main sphere of application for plunger pumps is the pressure range 250–300 bar and for abrasive media. The reason for plunger pumps being more suitable for high pressure is connected with their generally more robust construction (solid plunger piston), whilst better resistance to wear is brought about by the possibility of simply introducing water purging of the single-acting plunger. However it is known, from German Offenlegungsschrift No 2 552 828, that it is possible to introduce water purging also for piston pumps, although the technique illustrated in this patent publication has not been widely adopted. This can be regarded as being due to the fact that the design otherwise has a number of imperfections and disadvantages. Thus major technical problems are encountered with piston sealing, piston rod sealing and the cylinder bore in piston pumps, which among other things is connected with the fact that the pump is driven by an external motor via a piston rod which extends through the pump housing. With plunger pumps, as in accordance with U.S. Pat. No. 2,836,122, the plunger and plunger seal represent critical wear components.

A hydraulic drive pump of the displacement type is already known, e.g. from Swedish Pat. No. 412 939. With this pump it is possible to eliminate or restrict the above mentioned disadvantages of piston and plunger pumps. Thus this pump signifies a major technical advance. However in its technical design it differs radically from pumps of the piston or plunger type in that it operates with hose pump elements.

Further a hydraulic piston pump for the pumping of viscous, pulpy or plastic substances and particularly concrete is known from U.S. Pat. No. 3,146,721. In this pump solid particles may pass the pump piston sealing to the spece between the pump piston and the rear gable of the pump cylinder, which space is filled with flushing water under atmospheric pressure. The intention is that these particles shall be rinsed away from the flushing water section in connection with the return stroke (suction stroke) of the pump piston. The hydraulic piston is arranged in a separate hydraulic cylinder which is partitioned from the flushing water section of the pump by the said gable. The hydraulic piston and the pump piston are connected with one another by a piston stem extending through a seal in the gable, and the pump chamber is partitioned from the hydraulic section by the intermediate flushing water section which always is at zero pressure. Thus the pump piston sealing is not at a balanced pressure, that is to say the pressure difference over the seal corresponds to the full work pressure of the pump. Moreover the flushing system is designed only to rinse away such particles which have passed the pump piston sealing, which means that the pump piston sealing in no particular way is protected against wear and possible damage caused by particles in the pumping substance which are in direct contact with the sealing.

DISCLOSURE OF THE INVENTION

The aim of the present invention is to provide a pump which is suitable for high pressure and for pumping suspensions containing solid particles. More particularly, it is an object to provide a pump which as regards its construction is almost comparable with a piston pump, but which nevertheless has properties which make it quite suitable for the sphere of application of the plunger pump.

The object of the invention is also to create conditions to enable the pump to exhibit the following advantages.

- As distinct from piston seals and piston rod seals in conventional piston and plunger pumps, the pump seal shall not work in direct contact with the pumping medium and nor in non-lubricating media (water) but in a lubricating and non-contaminated medium under conditions which render the pump essentially maintenance-free. This is particularly important when pumping abrasive media where conventional pump seals exhibit a very restricted service lift.
- The pump shall have an extremely high mechanical efficiency because only negligible friction losses are to occur between the movable and non-movable components of the pump.
- Components critical for the sealing shall not be subjected to corrosive media, so that these components can be manufactured from cheap and, as far as the sealing function is concerned, most appropriate materials.
- The pump should have an extremely low mass of inertia in the reciprocating movable components as compared with the corresponding moving mass in conventional pump types. This is of particularly great importance in conjunction with high working pressures. The low inertial masses in the movable system imply, inter alia, that the pump requires a relatively light support and foundation arrangement which simplifies and cheapens its installation. Furthermore vibrations and oscillations are reduced even at relatively high pump stroke frequences.
- Thanks to the pump being hydraulically driven, the hydraulic drive components (hydraulic unit) can be located at any selected distance from the compact pump sections. Space requirements for the actual pump assembly are by this means reduced to a remarkable degree as compared with conventional pump installations.

The relatively small physical size, low inertia forces (=light construction) together with the use of less exclusive material combinations permit relatively reduced production costs for the pump.

These and other advantages can be achieved therein that the pump housing, which preferably is directed vertically, also contains an oil section arranged above the pump chamber having connections to a high pressure hydraulic unit (pressure source) for producing a working pressure on a working piston (hydraulic piston) or on a piston disc, said working piston and said pump piston being connected by means of at least one mechanical connecting member, that a clean water section is arranged between the oil section and the pump chamber, said clean water section extending between the working piston (the hydraulic piston) and the pump piston so that the front side of the working piston and the rear side of the pump piston are subjected to equal water pressure, said water pressure being of the same order as the pressures in the oil section and in the pump chamber, which means that the pressure forces acting on these two pistons will balance each other. Approximately the same magnitude in this connection shall mean that the pressure differences shall not be greater than +/−10% of the pump pressure, and preferably not greater than about +/−5%.

The working piston which is provided with sealing members against the surrounding cylinder wall thus operates in a lubricating medium (oil) of relatively high viscosity. Furthermore operation takes place at a very low pressure difference which together with the relatively high viscosity of the oil causes any tendency to leakage to be considerably less as compared with a conventional piston or plunger seal which operates in a medium of low viscosity (water) and at a pressure difference which corresponds to the full working pressure of the pump.

Because of the pressure balance in the pump of the present invention it is rendered possible and is appropriate to design all piston elements with an extremely small axial dimension so that the pistons will get the shape of discs. Hence in the following the expression disc will be employed, although also pistons of more conventional design are feasible within the scope of the invention.

To eliminate wear of the cylinder lining and in order to prevent the pumping medium from entering into the clean water- and oil sections it is furthermore advisable to provide the said gap between pump disc and cylinder wall such that it will define a relatively large opening through which a certain quantity of flushing water may flow from the clean water section into the pump chamber, and to provide a re-filling pipe for clean water to the clean water section in a manner which as such is already known from the said German Offenlegungsschrift No 2 552 828. Unlike the latter, in the pump of the invention the pump disc is suitably provided with an elastic sealing sleeve, which however is not in contact with the cylinder wall during the compression stroke (giving very small resistance against flows of flushing water from the clean water section to the pump chamber) but which is provided to shut the gap during the suction stroke. Hence the pumping medium is prevented from being forced up into the clean water section during the suction stroke or when the pump is not in operation. One significant advantage of the pump in accordance with the invention is that this achievement can be integrated in a fully hydralically driven pump. According to a preferred embodiment of the invention, the pump is also provided with means for automatic deaeration and flushing of the clean water section.

Further advantages and characteristic features of the invention will be apparent from the following description of some preferred embodiments and from the appending claims.

BRIEF DESCRIPTION OF DRAWINGS

In the following description of preferred embodiments reference will be made to the appended drawings, in which

FIG. 3 illustrates the conditions during the suction stroke, wherein FIG. 3A correspondingly shows the same detail as in FIG. 2A.

DESCRIPTIONS OF PREFERRED EMBODIMENTS

Figure 1:
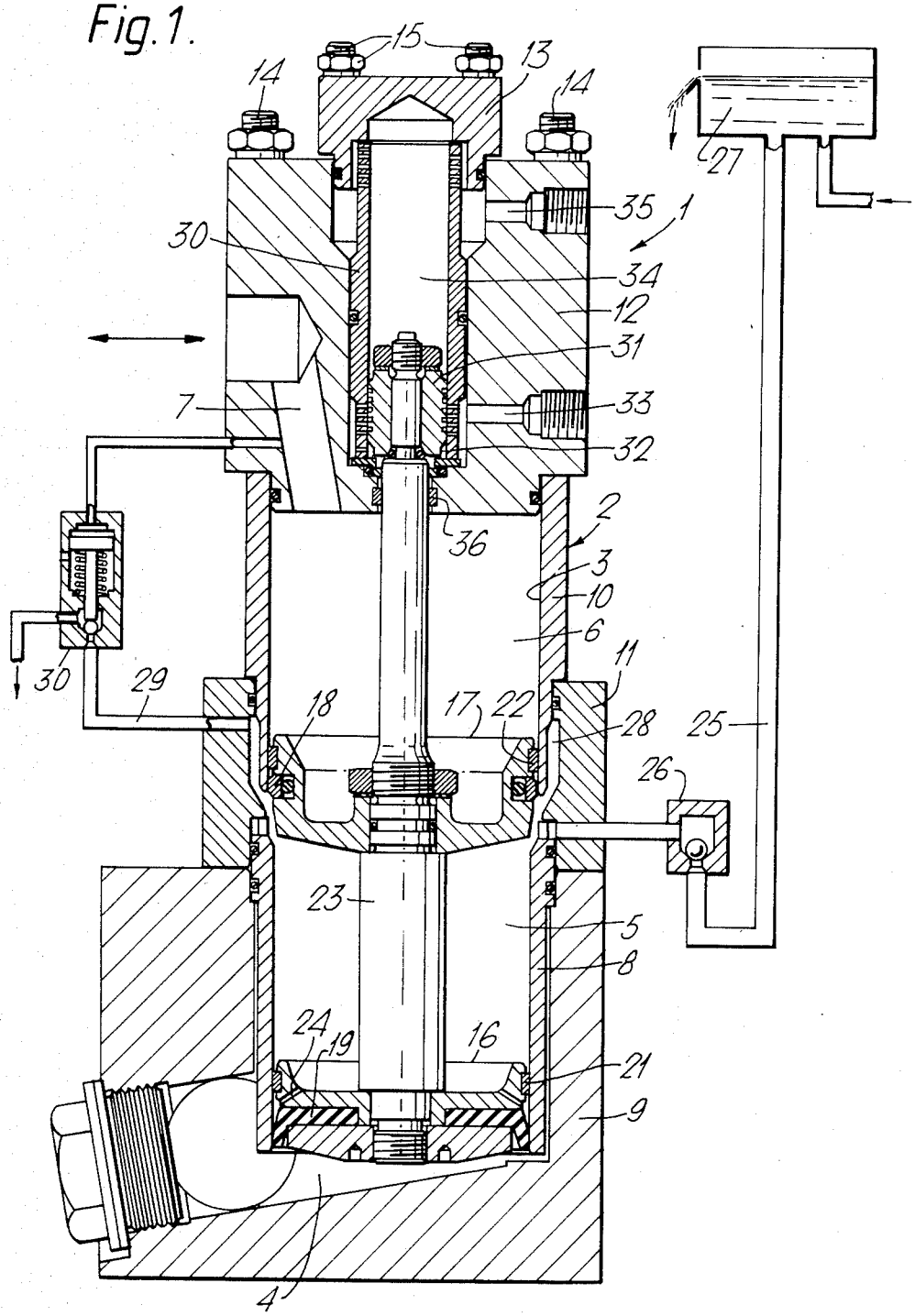
FIG. 1 shows an axial vertical section through the pump according to a preferred embodiment of the invention. In the drawing external units which are connected to the pump have been shown only schematically.

The pump 1 which is partly schematically illustrated in FIG. 1 has a pump housing 2 and is constructed as a vertical piston pump. The pump housing 2 contains three different liquid media, these being hydraulic oil, clean water and the slurry to be pumped. The latter is accommodated in a pump chamber 4. The clean water section is designated as 5 and is arranged above the pump chamber 4. The oil section 6 in its turn is arranged above the clean water section 5 and consists of an oil pressure chamber in an upper cylinder 10, the inside of which is shown as 3. The oil section 6 is connected to a hydraulic unit (a pressure source) through a conduit 7. The pump housing 2 also includes a lower cylinder 8, which is a lining in a lower block 9. In the position shown in FIG. 1, which illustrates the final phase of the compression stroke, the lower cylinder 8 defines the said clean water section 5. The upper cylinder 10, which is single walled, is connected with the lower cylinder 8 by an intermediate collar 11. A top block is shown as 12 and an auxiliary cylinder head is shown as 13. Members 9, 10, 11, 12 and 13 are kept together by means of bolts 14 and 15.

Figure 2:
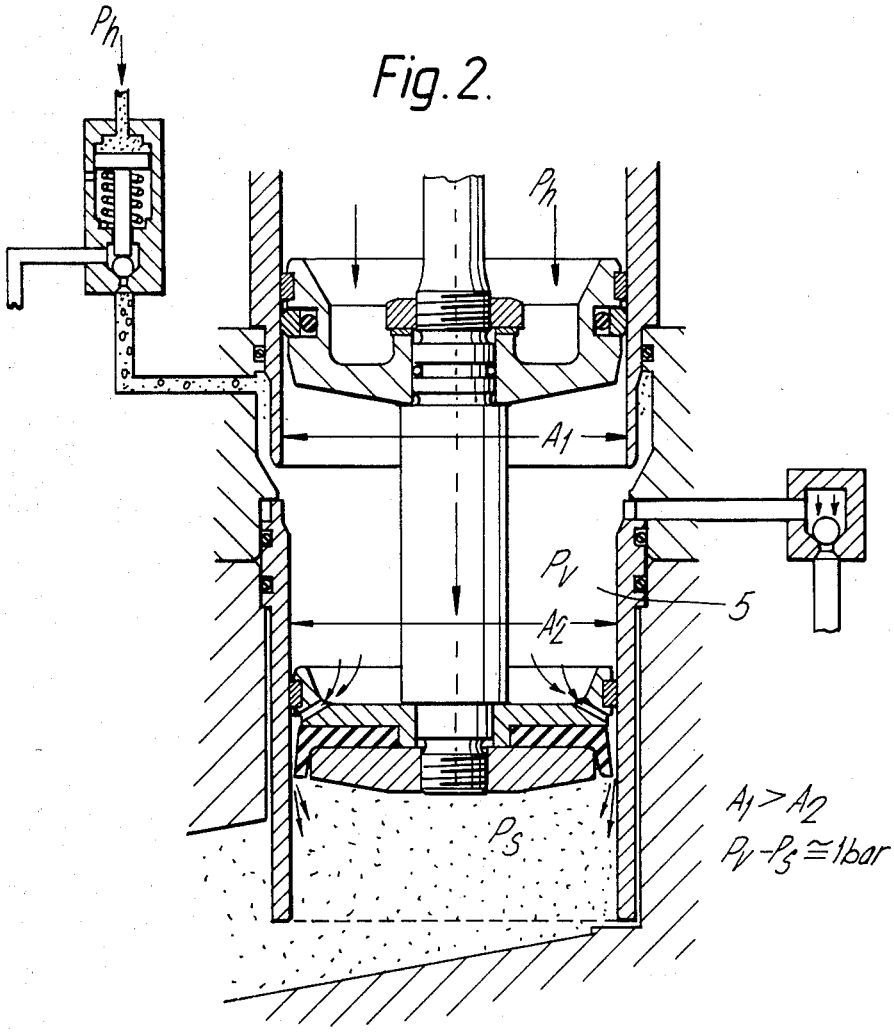
FIG. 2 illustrates the pressure- and flow conditions in the pump during the compression stroke.

The upper cylinder 10 has a larger inner diameter than the lower cylinder 8. The clean water section 5 thus has a larger cross section area A1 in its upper part within the region of the upper cylinder 10 than in its lower part within the region of the lower cylinder 8-(A1>A2)-as illustrated in FIG. 2.

The slurry section is designed as a conventional pump chamber 4 with inlet and outlet pipes for the slurry which is to be pumped. Non-return valves are arranged in a known manner in the conduits.

The movable piston system consists of two disc-shaped boundaries between the different sections. These boundaries are the pump disc 16 and the working piston (hydraulic piston) or the working disc 17 which forms the boundary between the oil pressure chamber 6 and the clear water section 5. Only the top disc (the working piston 17) is provided with a sealing member, corresponding to the piston seal in a conventional pump, in the form of a sealing ring 18 against the upper cylinder wall 13. It is true that also the pump piston 16 is provided with a sealing sleeve-the sleeve 19-between the pump chamber 4 and the clean water section 5, but the purpose of this sleeve is to seal the gap 20 between said sections only during the suction stroke or during periods of rest of the pump, while clean water may pass through the gap during the compression stroke of the pump, FIG. 2A. The two piston discs 16 and 17 are further provided with guides 21 and 22, respectively, of PTFE (polytetrafluoroethylene) or corresponding low friction material in order further to improve the sliding features of the piston system. The working disc 17 and the pump disc 16 are connected with each other by a vertical axial connecting rod 23.

Figure 2A:
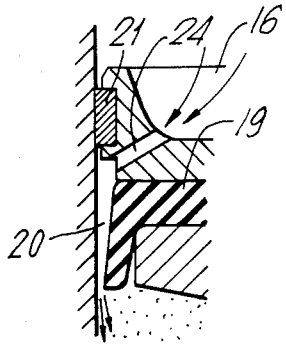
FIG. 2A illustrates a detail of the pump piston during the compression stroke on a larger scale.

The oil pressure chamber, that is to say the oil section 6 above the working piston 17, is filled with oil whilst the clean water section, that is to say the space 5 between the working disc 17 and the pump disc 16 is filled with clean water, the volume of which is reduced during the pump compression stroke because A1>A2, so that some water is made to flow outwards through the gap 20 which is made possible because the resilient sleeve 19 is folded inwards as is shown in FIG. 2A. In order to enhance this flow, passages 24 are provided in the pump piston disc 16. The water volume in the clean water section 5 is automatically refilled during the suction stroke via an outer conduit 25 connected to the clean water section 5 via a non-return valve which during the compression stroke shuts this connection. A clean water reservoir has been designated 27.

In the upper part of the clean water section 5, when the two piston discs 16 and 17 are in their lower position, there is an annular space 28. This space consists of an outer recess in the lower part of the cylinder 10 and an inner recess in the intermediate collar 11 between the lower cylinder 8 and the upper cylinder 10. The incoming clean water conduit 25 terminates immediately below this annular space 28. Because of the position of the annular space 28 any air which may be introduced into the clean water section 5 together with the refill water as well as those very small oil quantities which possibly may be forced in from the oil pressure chamber 6 are collected in the space 28. From this space these non-desired air- and oil particles can be rinsed away through a conduit 29 during the suction stroke of the pump. The conduit 29 is arranged in the upper part of the annular space 28. A valve 30, which is controlled by the oil which is under pressure in the oil pressure chamber 6, is kept closed during the compression stroke of the pump, FIG. 2, but will open the connection between the space 28 and the exterior during the suction stroke, FIG. 3, and at the same time the refilling valve 26 will open for refilling and flushing of the clean water section 5. This arrangement will not only bring about an automatic deaeration of the clean water section 5 but also that 100% tight seal of the piston sealing 18 is not absolutely nessecary for a proper operation. To the contrary the presence of a lubricating oil film on the cylinder wall 3 is advantageous and desirable. For that purpose the different functioning aereas have been adapted to each other in such a way that a slight over-pressure always prevails in the oil section 6 in relation to the clean water section 5 (Ph>Pv). Cheap and non-complicated piston sealings of low friction type which do not have the ability of removing the oil film, therefore advantageously may be used for the piston sealing 18 in this pump.

The upper portion of the pump housing 2 contains an auxiliary cylinder 30 beneath the auxiliary cylinder head 13 in the top block 12. The connecting rod 23 extends upwards into this auxiliary cylinder 30 where it is provided with a small auxiliary piston 31. A chamber 32 underneath the auxiliary piston 31 communicates with the compression oil through a conduit 33 from the hydraulic unit which is not illustrated. The chamber 34 above the auxiliary piston 3 communicates with a return side of the hydraulic system through a return conduit 35. Drive oil from the hydraulic unit is passed to the oil pressure chamber 6 during the compression stroke through said passage 7. A connection rod seal 36, which is not critical, is provided between the oil pressure chamber 6 and the chamber 32 underneath the auxiliary piston 31.

The pump thus described functions as follows. When the pump is to perform a working stroke (compression stroke), FIG. 2, it is assumed that the disc piston system, i.e. the components which are connected by the connecting rod 23, initially are in their extreme top position and that the pump chamber 4 is filled with slurry which has been fed (sucked) in through the pump inlet valve, while the clean water section 5 is filled with clean water. High pressure oil from an external hydraulic unit is passed through the passage 7 into the oil pressure chamber 6 above the working piston 17 and to the deaeration- and flushing valve 30 so that the connection 29 between the annular space 28 and exterior is closed. The pressure oil in the oil section 6 exerts a downwardly directed force on this working disc 17 which is provided with a sealing ring 18. Hereby the piston system starts moving downwards, whereby a corresponding back-pressure is built up in the pump chamber 4 until the outlet valve (not shown) on the outlet side of the pump is opened, whereafter the slurry is pressed out through the pump outlet pipe. During the downwards-directed movement the liquid volume in the clean water section 5 is reduced because of the above mentioned area difference A1−A2, which in its turn will give rise to immediate increase of the pressure in the clean water section. The pressure in the clean water section 5 increases until it is slightly higher than the pressure in the pump chamber 4, whereafter the sleeve 19, which makes very little resistance against the water flow, opens the connection between the clean water section and the pump chamber, so that clean water can flow out from the clean water section through the gap 20 down to the pump chamber 4. During the continued piston movement the volume difference thereafter will be pressed down from the clean water section into the pump chamber through the gap 20, passing the sleeve 19. In this way purge cleaning of the cylinder wall in the pump chamber 4 is ensured immediately in front of the pump disc 16 during its movement, at the same time as the slurry efficiently is prevented from penetrating into the other sections or that any solid particles are trapped between the cylinder and the movable piston system. The size of the flushing water volume is determined by a proper choice of the area difference A1 minus A2, and the proportional admixture in the pump flow therefore always will be constant.

It is also apparent from the above that the main components of the piston system, namely the working disc 17 and the pump disc 16, are essentially balanced out with reference to the pressure forces and this is the reason for the fact that it is possible to employ very light piston elements, even though the pump working pressure is very high. One can say that the working disc 17, the clean water section 5 and the pump disc 16 in combination form an integrated pump piston having a significant axial length but a comparatively small inertial mass.

The upward-directed suction stroke is brought about by means of pressure oil existing in the chamber 32 underneath the auxiliary piston 31, at the same time as oil existing in the oil section 6 is returned to the hydraulic unit through the passage 7, which now acts as a return conduit. At the same time the valve 30 is disengaged so that the conduit 29 is opened between the annular space 28 and the exterior. During the suction stroke the volume in the clean water section 5 is increased because of the area difference A1 minus A2 (corresponding to the flushing water volume which has been pressed out to the pump chamber 4 during the working stroke), and the section 5 is automatically refilled from the clean water reservoir 27 via the pipe 25 and the non-return valve 26. At the same time possible collection of air and oil residuals are expelled and are flushed out to the exterior from the annular space 28 together with surplus flushing water through the conduit 29 and the valve 30 as is shown in FIG. 3.

Figure 7:
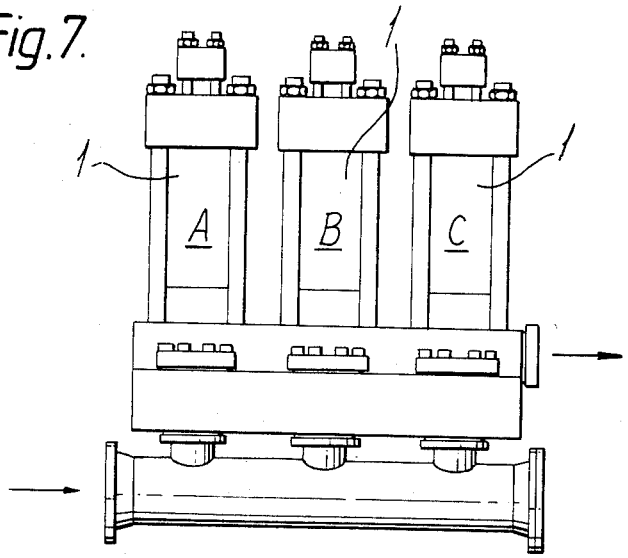
FIG. 7 illustrates a battery of three pumps in a triple pump arrangement corresponding to a view VII—VII in FIG. 6.
Figure 8:
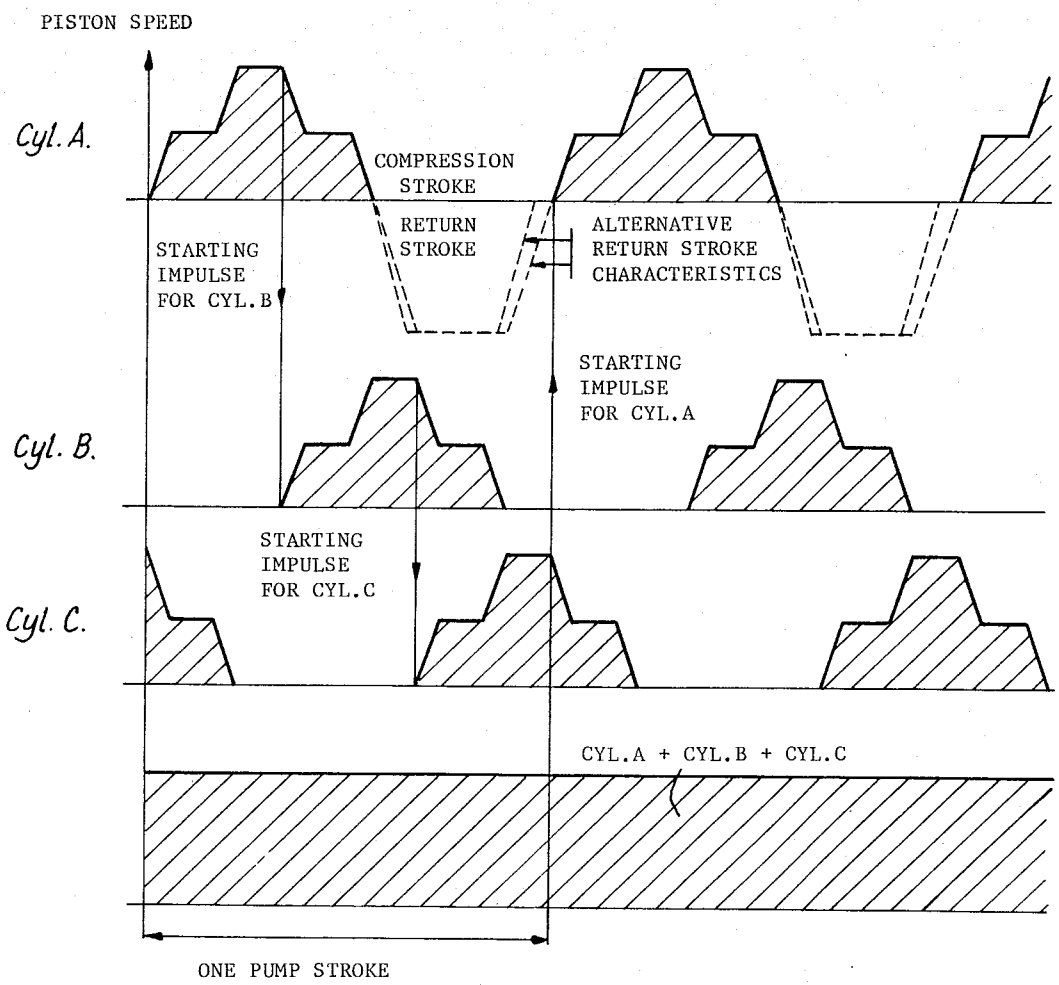
FIG. 8 illustrates the velocity profiles for the different cylinders in the triple pump arrangement shown in FIG. 7.

Apart from executing the pump return stroke the above-mentioned auxiliary piston 31 has the function of bringing about controlled damping of the piston movement at the respective extreme positions. Furthermore the auxiliary piston can be employed for controlling pump movements in for example a triple pump arrangement of the type illustrated in FIG. 7, by this means obtaining a discharge flow which is essentially free from pulsations. FIG. 8 illustrates the velocity profiles of the different cylinders with such a triple pump arrangement in an idealised case.

The pressure conditions in the pump shown in FIG. 1 can be illustrated by the following example. At full hydraulic pressure Ph = 100 bar in the pressure chamber 8 above the working piston 17 which has an area A1, and in the cavity 32 underneath the auxiliary piston 31 which has an area A3 minus A4, a pump pressure of Ps = 94 bar is obtained in the pump chamber 4. The pressure Pv in the clean water section 5 amounts to 95 bar, giving a pressure difference above the piston seal 18 of only 5 bar. As the connecting rod 23 above the working disk 17 has a cross-sectional area of A4, we get the following equilibrium conditions:

$$(A1\ A4)\cdot Ph = A2\cdot Ps + (A1\ A2)\cdot Pv + (A3\ A4)\cdot Ph$$

Figure 4:
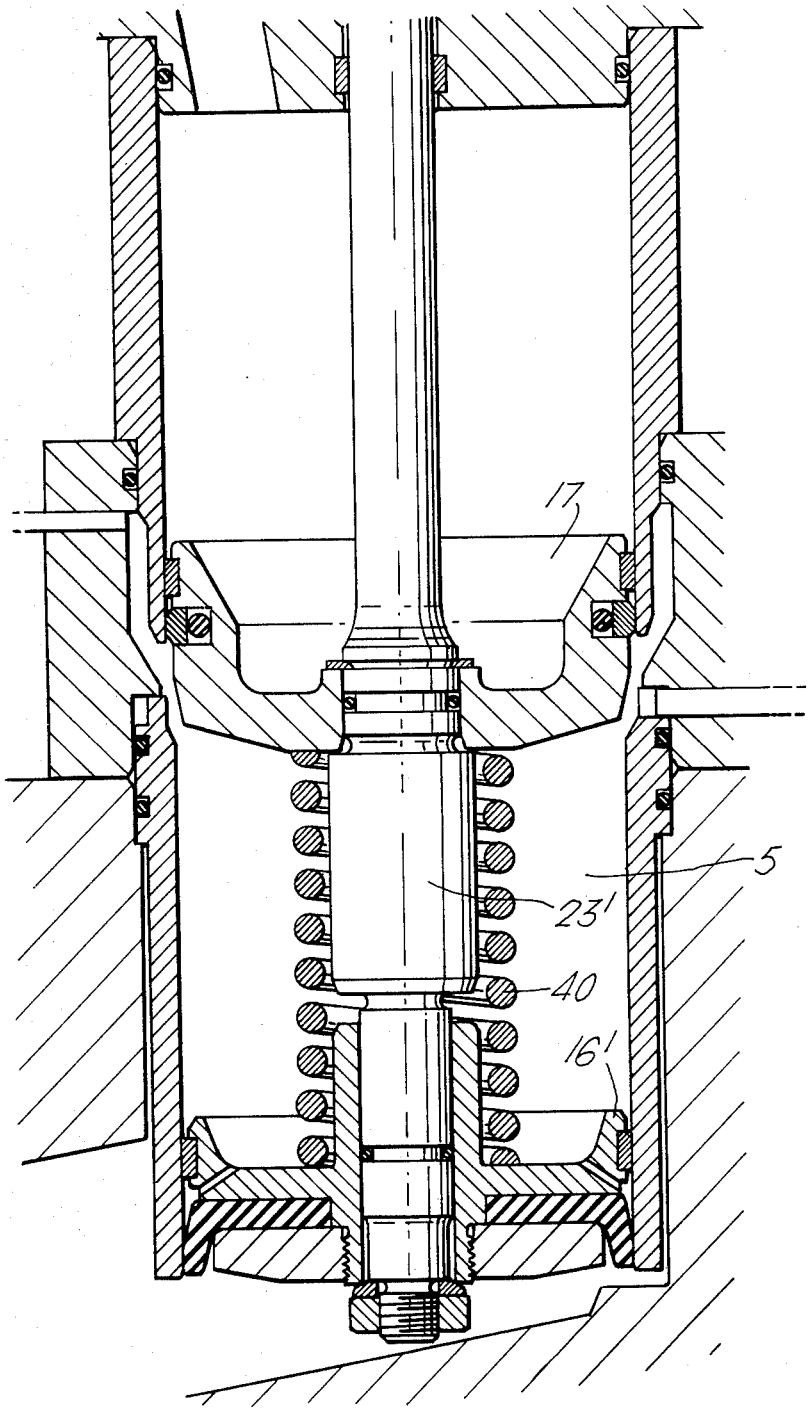
FIG. 4 illustrates an embodiment according to a first modification of the invention.
Figure 5:
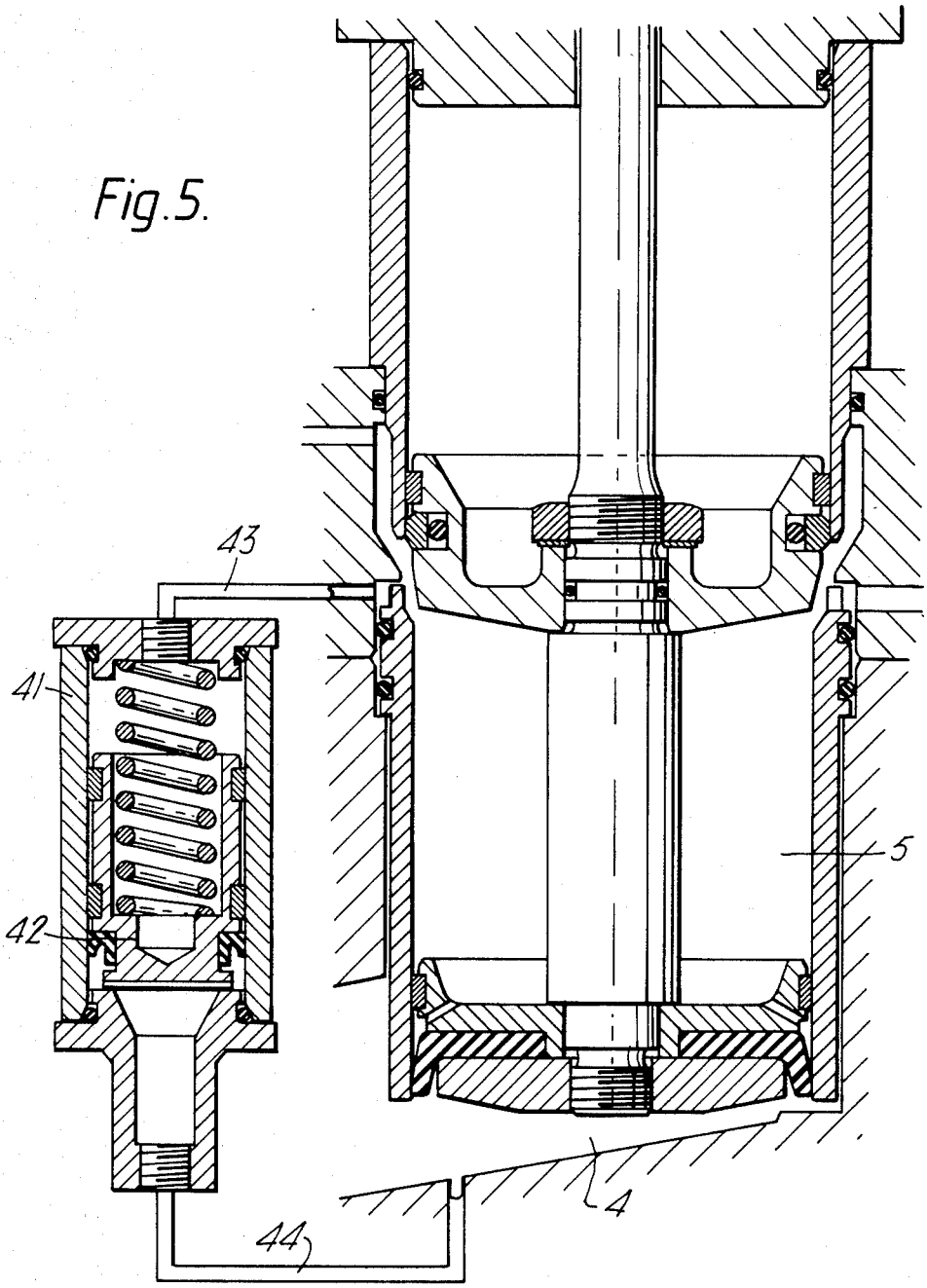
FIG. 5 illustrates an embodiment according to a second modification of the pump according to the invention.
Figure 6:
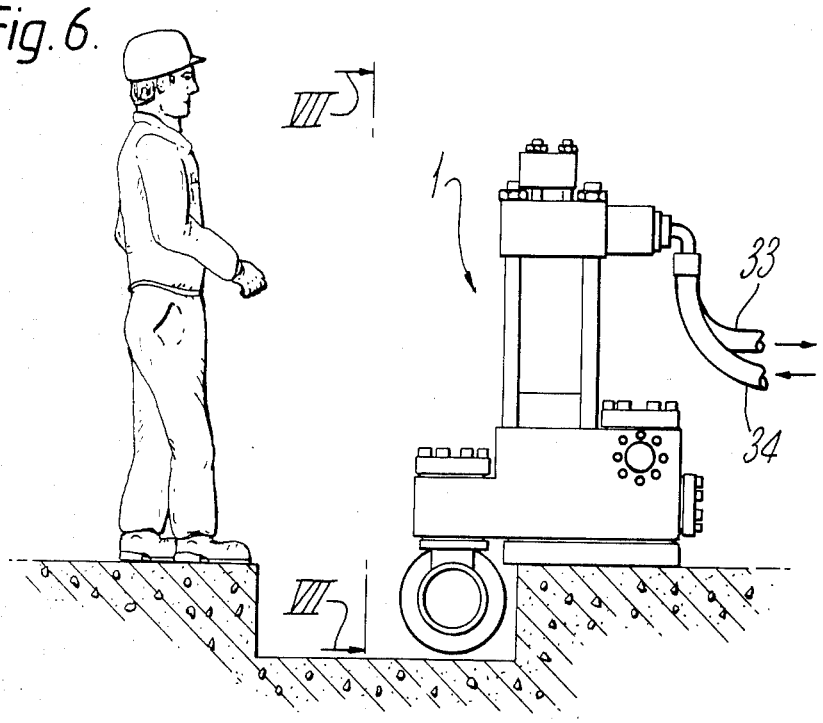
FIG. 6 is a side view of a pump in accordance with the invention which illustrates the external dimensions of the pump.

For pumps intended to work at very high pumping pressures also the compressibility of the liquids should be considered. FIG. 4 and FIG. 5 show two different provisions for the compensation of the compressibility of the liquid in the clean water section 5. According to the embodiment shown in FIG. 4 this compensation is achieved therein that the working piston 17' is provided axially movable on the connection rod 23 such that the volume difference caused by the compressibility of the liquid in the clean water section 5 can be balanced by a slight relative movement between the piston discs 17' and 16, which takes place before the start of the pumping movement. A spring 40 between the piston discs 17' and 16 is provided to bring the working piston 17' back to its upper starting position during the suction stroke.

The arrangement according to FIG. 5 basically employs a separate cylinder 41 with a movable and spring-loaded piston 42 which is connected via conduits 43 and 44 to the clean water section 5 and the pump chamber 4, respectively, of a pump which in other respects may have the same design as the pump 1 according to FIG. 1. Herethrough there is automatically obtained a compensation of the liquid volume changes in the clean water section 5, and by means of the movable piston 42 there is obtained substantially equal pressures in the clean water section and in the pump chamber in spite of volume changes of the water because of the compression at very high pressures.

I claim:

1. A hydraulically driven pump of the displacement type suitable for pumping a pumping medium at high pumping pressures, said pump comprising:

(a) a pump housing;

(b) a pump chamber provided in said pump housing having an inlet conduit and an outlet conduit with associated respective inlet and outlet valves;

(c) a pump piston arranged in a pump cylinder in said pump chamber, said pump cylinder having a pump cylinder wall, said pump piston and said pump cylinder wall defining a comparatively large gap therebetween;

(d) an oil section arranged above said pump chamber;

(e) a working piston arranged in an oil section cylinder in said oil section, said oil section cylinder having an oil section cylinder wall, said working piston being connected to said pump piston through at least one mechanical connecting member;

(f) a first sealing means mounted on said working piston for sealing said working piston against said oil section cylinder wall;

(g) a second sealing means mounted on said pump piston for preventing flow of pumping medium into contact with said first sealing means on said working piston during a suction stroke of said pump;

(h) a clean water section arranged between said oil section and said pump chamber, said clean water section extending between said working piston and said pump piston so that the same water pressure (Pv), which is approximately of the same magnitude as pressures in said section and in said pump chamber, is exerted on a front side of said working piston as on a rear side of said pump piston.

2. A pump according to claim 1, wherein said clean water section has a front portion and a rear portion said front portion having a smaller diameter than said rear portion, so that the volume of said clean water section is reduced during a compression stroke of said pump, whereby clean water during said compression stroke of said pump is caused to flow out of said clean water section into said pump chamber through said gap, and wherein a refilling conduit having a non-return valve is connected to said clean water section for refilling clean water during said suction stroke of said pump.

3. A pump according to claim 2, wherein said second sealing means comprises a sealing sleeve of soft elastic material, said sealing sleeve being bent aside by clean water flowing out of said clean water section into said pump chamber through said gap during said pump compression stroke, said sleeve resting against said cylinder wall during said suction stroke and while said pump is inoperative, to thereby prevent said pumping medium from flowing into said clean water section.

4. A pump according to claim 1, 2 or 3, and further including an auxiliary piston above said oil section and separated from said oil section by a stationary partition, said auxiliary piston being connected to said working piston and being provided to effect said suction stroke.

5. A pump according to claim 1, 2 or 3, and further including a deaeration conduit to said clean water section for removal of air and residual oil from said clean water section during said suction stroke.

6. A pump according to claim 5, including a valve in said deaeration conduit, said valve being operated by pressure in a hydraulic medium so that said valve is open during said suction stroke when said pressure and said hydraulic medium is low.

7. A pump according to claim 5, wherein said pump is arranged vertically and said deaeration conduit is connected to an annular space in an upper part of said clean water section when said pump piston is its lower position.

8. A pump according to claim 1, wherein a spring is provided between said pump piston and said working piston, said pump piston and said working piston being axially moveable towards each other compressing said spring to compensate for compression of water in said clean water section due to very high pump pressure.

9. A pump according to claim 1, and further including a separate cylinder having a moveable and spring loaded piston, said cylinder being connected by a conduit to said clean water section and said pump chamber for automatic compensation of liquid volume changes in said clean water section due to compression at very high pressures.

* * * * *